US008172284B2

(12) United States Patent
Chern

(10) Patent No.: US 8,172,284 B2
(45) Date of Patent: May 8, 2012

(54) DOOR HANDLE

(76) Inventor: Der-Yuh Chern, Pingtung (TW)

( * ) Notice: Subject to any disclaimer, the term of this patent is extended or adjusted under 35 U.S.C. 154(b) by 459 days.

(21) Appl. No.: 12/416,169

(22) Filed: Apr. 1, 2009

(65) Prior Publication Data

US 2010/0253100 A1 Oct. 7, 2010

(51) Int. Cl.
*E05B 3/00* (2006.01)
*E05B 15/02* (2006.01)

(52) U.S. Cl. ..... 292/336.3; 292/340

(58) Field of Classification Search ..... 292/336.3, 292/347, 348, 349, DIG. 61
See application file for complete search history.

(56) References Cited

U.S. PATENT DOCUMENTS 1,519,500 A * 12/1924 Miller ..... 292/356
1,519,503 A * 12/1924 Norwood et al. ..... 292/356
1,799,253 A * 4/1931 Rogers ..... 292/350
3,028,993 A * 4/1962 Muhlhoff ..... 220/321
3,044,817 A * 7/1962 Marcante ..... 292/336.3
4,921,289 A * 5/1990 Shen ..... 292/336.3
5,060,991 A * 10/1991 Davidian et al. ..... 292/172
5,354,109 A * 10/1994 Lin ..... 292/1.5
5,685,182 A * 11/1997 Chhatwal ..... 70/224
6,223,572 B1 * 5/2001 Marttinen ..... 70/370
7,306,265 B1 * 12/2007 Green et al. ..... 292/194

* cited by examiner

*Primary Examiner* — Thomas Beach
*Assistant Examiner* — Nathan Cumar
(74) *Attorney, Agent, or Firm* — Leong C. Lei

(57) ABSTRACT

The door handle contains a positioning element, an engaging ring, and a handle member. The positioning element is flat and substantially rectangular with four rounded corners. Four notches are formed besides the four corners, respectively. The inner circumference of the engaging ring is divided equally into four arc sections, each having a J-shaped track. Along the outer circumference of the engaging ring, a curved slot where an elastic plate is embedded and a neighboring axial groove are provided. After the positioning element is fixed to a lock on a door, the engaging ring and a first cover of the handle member are sleeved over the positioning element. By twisting the first cover which in turn rotates the engaging ring, the four corners follow the J-shaped tracks and are thus locked and the elastic plate is embedded into one of the notches.

4 Claims, 5 Drawing Sheets

DOOR HANDLE

TECHNICAL FIELD OF THE INVENTION

The present invention generally relates to door handles, and more particularly to an easy-to-assemble, appealing, and secure door handle.

DESCRIPTION OF THE PRIOR ART

A conventional door handle has a pair of symmetric inner and outer pieces with relevant elements inside for fixing the pieces to a lock member on a door and, then by twisting either the inner or outer piece, the door is opened or closed. Traditionally, the door handles are bulky and not appealing. The installation of a door handle is also quite complicated and the door handle could often be broken loosed by brute force. In other words, the door handles are not as secure as people expect.

SUMMARY OF THE INVENTION

Accordingly, the present invention provides a novel door handle that is easy-to-assemble, appealing, and secure.

The door handle contains a positioning element, an engaging ring, and a handle member. The positioning element is flat and substantially rectangular with four rounded corners. Four notches are formed besides the four corners, respectively. The inner circumference of the engaging ring is divided equally into four arc sections, each having a J-shaped track. Along the outer circumference of the engaging ring, a curved slot where an elastic plate is embedded and a neighboring axial groove are provided. After the positioning element is fixed to a lock on a door, the engaging ring and a first cover of the handle member are sleeved over the positioning element. By twisting the first cover which in turn rotates the engaging ring, the four corners follow the J-shaped tracks and are thus locked and the elastic plate is embedded into one of the notches.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
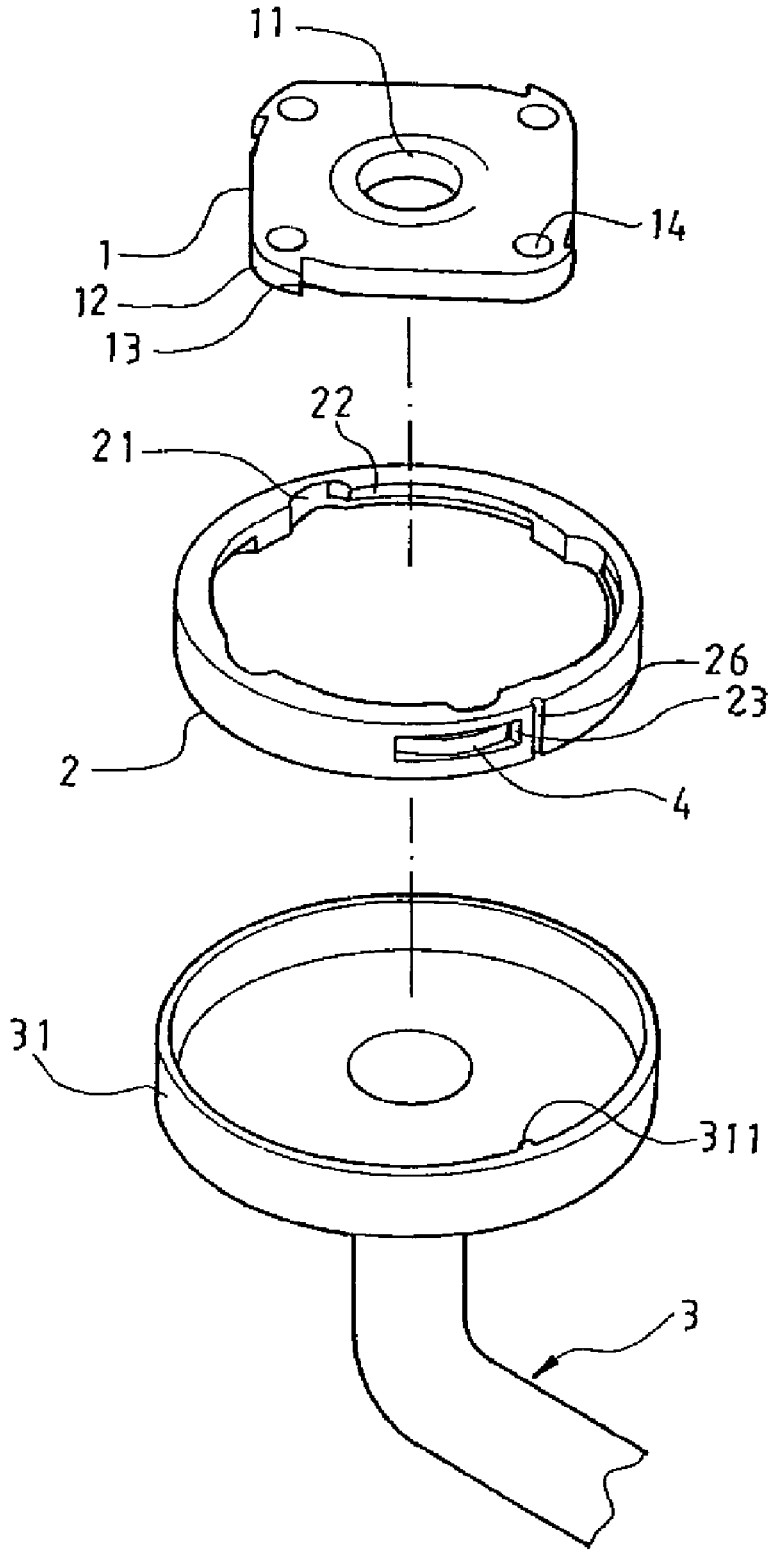
FIG. 1 is a perspective break-down diagram showing a door handle according to an embodiment of the present invention.
Figure 2:
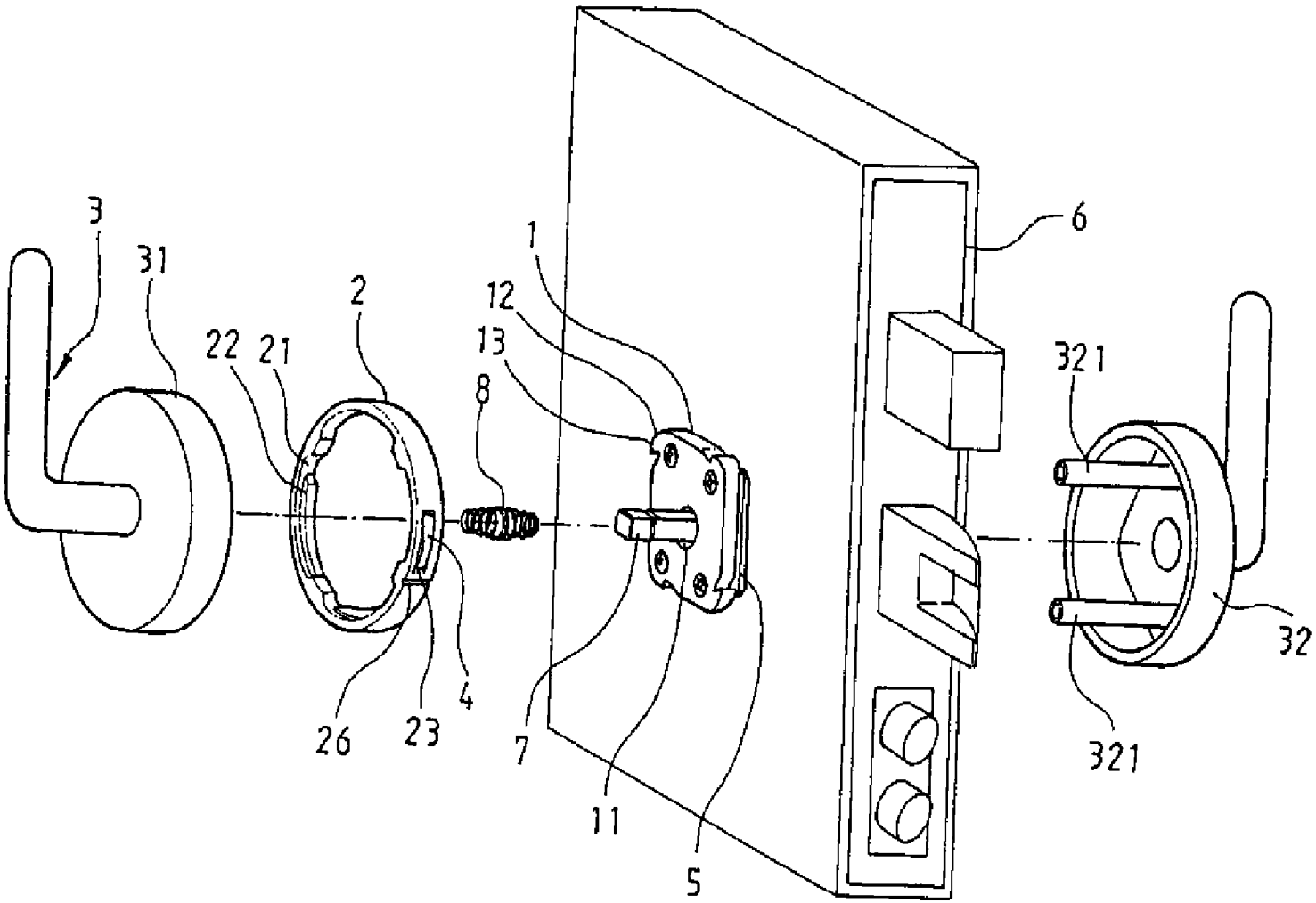
FIG. 2 is a perspective break-down diagram showing an engaging ring of the door handle of FIG. 1.
Figure 3:
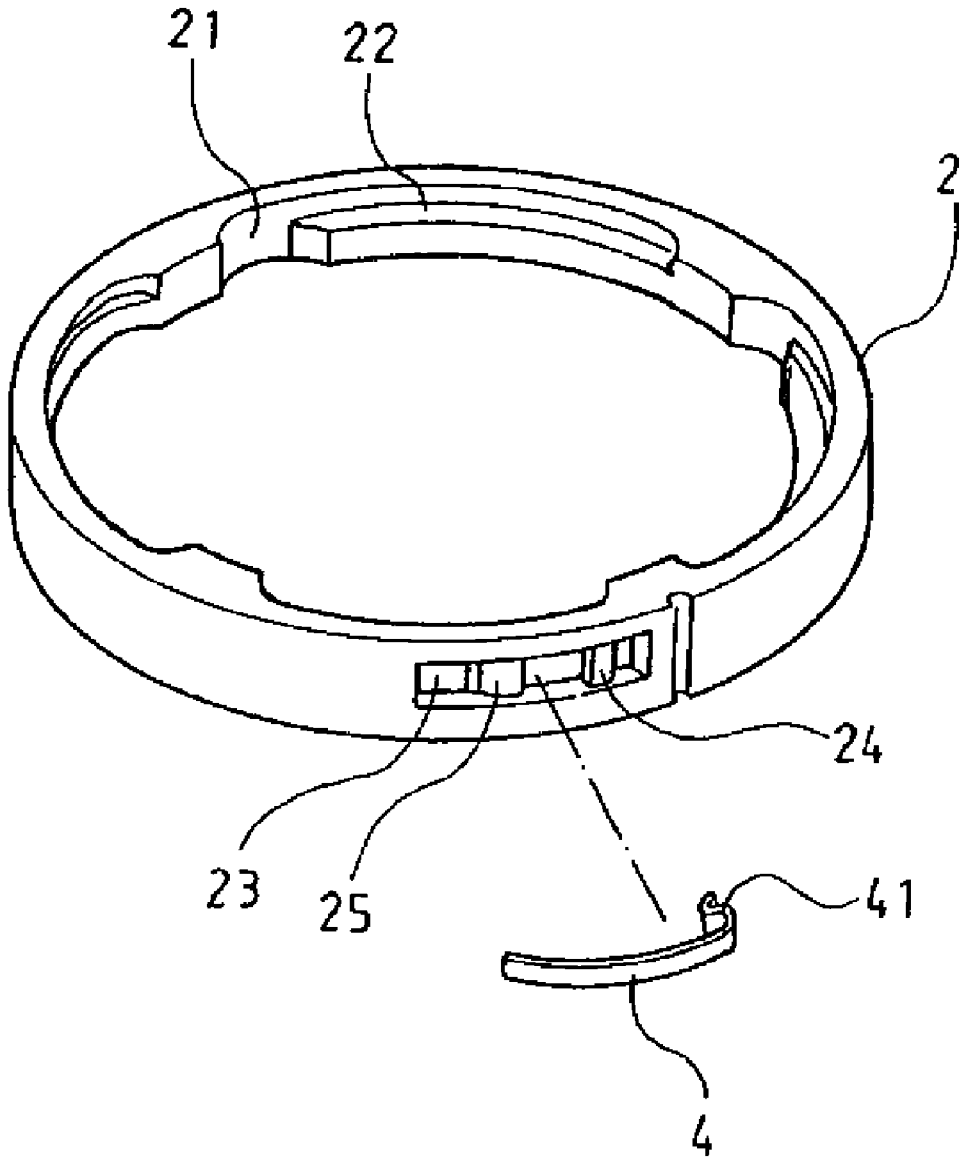
FIG. 3 is a perspective diagram showing the assembly of the door handle of FIG. 1 to a door.

Please refer to FIGS. 1 and 2, along with FIG. 3. A door handle according to an embodiment of the present invention contains a positioning element 1, an engaging ring 2, and a handle member 3. The positioning element 1 is flat and substantially rectangular with a center through hole 11 and four rounded corners 12. The positioning element 1 has four bolt holes 14 adjacent to the four corners 12, respectively. The circumference of the positioning element 1 is chipped to form four notches 13 besides the four corners 12, respectively.

The inner circumference of the engaging ring 2 is divided equally into four arc sections. Each arc section has a curved indentation 21. Further in each curved indentation 21, there is a step 22 whose height is roughly half of that of the curved indentation 21 extending from an end of the curved indentation 21 to a point close to the other end. As such, a J-shaped track is actually formed inside each arc sections. Along the outer circumference of the engaging ring 2, there is a curved slot 23 within which a first axial column 24 and a second axial column 25 are provided. Also on the outer circumference of the engaging ring 2 and adjacent to the curved slot 23 is an axial groove 26.

The handle member 3 contains a first piece and a second piece. The first piece contains an L-shaped handle bar (not numbered) whose one end is joined to the center of an outer side of a flat cylindrical first cover 31. Similarly, the second piece contains an L-shaped handle bar (not numbered) whose one end is joined to the center of an outer side of a flat cylindrical second cover 32. Along the inner wall of the first cover 31, an axial rib 311 is provided. When the engaging ring 2 is positioned inside the first cover 31, it is immediately positioned by aligning and embedding the axial rib 311 into the axial groove 26. The second cover 32 has two axial poles 321 extending axially inward.

A slim elastic plate 4 has a bended first end 41 which is used to wind around the first column 24 while a part of the rest of the elastic plate 4 is against the second axial column 25 and a free second end (not numbered) sticks outward.

The door handle is assembled as follows. The positioning element 1 is first bolted to a lock 6 by two opposing bolt holes 14. A spring 5 is sandwiched between the positioning element 1 and the lock 6. The poles 321 of the second piece then are threaded through the other two opposing bolt holes 14 of the positioning element 1. Then bolts are applied to lock both the positioning element 1 and the second piece fixedly together. A spindle 7 is positioned to penetrate the center through hole 11 of the positioning element 1 and a spring 8 is sleeved over the spindle 7. Finally, the engaging ring 2 and the first piece are affixed to the positioning element 1.

Figure 4:
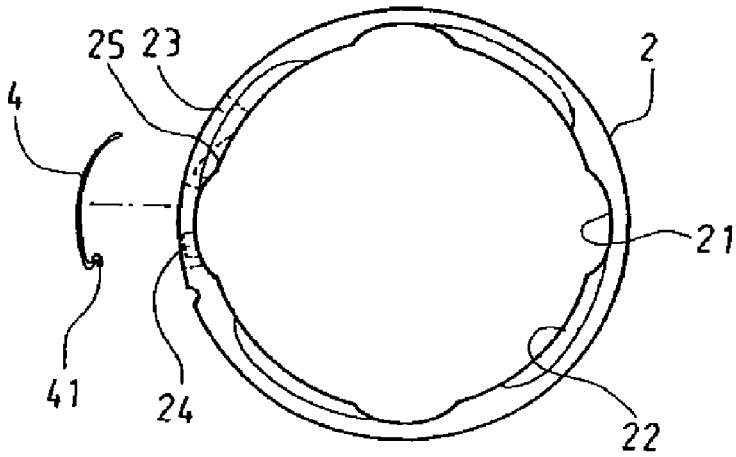
FIG. 4 is an axial-view diagram showing the engaging ring of the door handle of FIG. 1.
Figure 6:
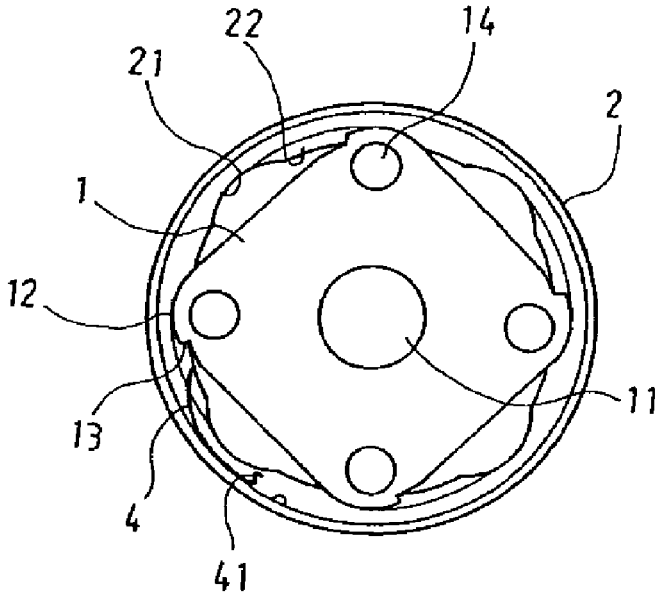
FIG. 6 is an axial-view showing another scenario of the interaction of the engaging ring and the positioning element of the door handle of FIG. 1.
Figure 5:
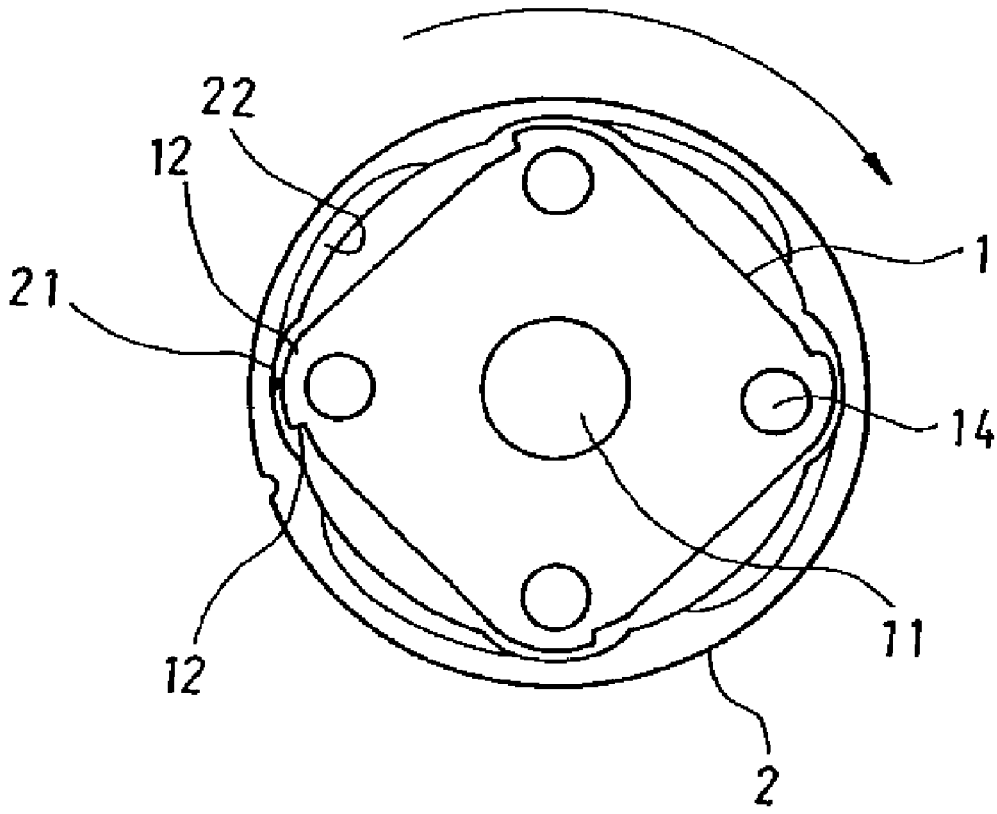
FIG. 5 is an axial-view showing a scenario of the interaction of the engaging ring and a positioning element of the door handle of FIG. 1.

As shown in FIGS. 4 to 6, the four curved indentations 21 of the engaging ring 2 are configured to form a larger area so as to allow the accommodation of the four corners 12 of the positioning element 1. Then, by twisting the first cover 31 of the first piece which in turn rotates the engaging ring 2, the four corners 12 follow the J-shaped tracks and are thus locked by the steps 22.

By continuing twisting the first cover 31 and, therefore, the engaging ring 2, the free second end of the elastic plate 4 eventually is embedded into one of the notches 13 of the positioning element 1. As such, the first cover 31 cannot be easily twisted toward the opposite direction to disassemble the door handle of the present invention.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A door handle, comprising:

a flat and substantially rectangular positioning element having four rounded corners, a center through hole, and four notches along the circumference of said positioning element adjacent to said four corners, respectively, the positioning ring being adapted to fix to a lock of a door and receive a spindle of the lock through said center through hole;

an engaging ring, which has an inner circumference divided equally into four arc sections, each having a curved indentation, each curved indentation having a step whose height is roughly half of that of said curved indentation extending from an end of said curved indentation to a point close to the other end of said curved indentation, thereby forming a J-shaped track, a slim elastic plate having a first end fixedly attached to the circumference of said engaging ring and a free second end, an axial groove being provided along an outer circumference of said engaging ring;

a handle member having at least a portion, which comprises a cylindrical cover and a handle attached to an outer side of said cover, an axial rib being provided along an inner wall of said cover, said engaging ring being received in said cover with said axial rib being fit into the axial groove of said engaging ring, so that said cover and said engaging member are rotatably coupled together;

wherein said engaging ring and said first piece are twisted together to lock to said positioning element as said four corners of said positioning element enter said curved indentations and slide into said tracks, respectively, and the free second end of said elastic plate being received in one of said four notches to prevent free disengagement of the handle member.

2. The door handle according to claim 1, wherein said curved indentations of said engaging ring jointly form an area larger than said positioning element.

3. The door handle according to claim 1, wherein a curved slot is provided along the outer circumference of said engaging ring; and, inside said curved slot; a first axial column and a second axial column are provided for positioning said elastic plate.

4. The door handle according to claim 3, wherein said first end of said elastic plate is bended to wind around said first axial column inside said curved slot; and a part of said elastic plate is against said second axial column.

* * * * *